US005839294A

United States Patent [19]

Chiang et al.

[11] Patent Number: 5,839,294

[45] Date of Patent: Nov. 24, 1998

[54] CHILLER WITH HYBRID FALLING FILM EVAPORATOR

[75] Inventors: Robert H. L. Chiang; Jack L. Esformes, both of Manlius; Edward A. Huenniger, Liverpool, all of N.Y.

[73] Assignee: Carrier Corporation, Syracuse, N.Y.

[21] Appl. No.: 752,341

[22] Filed: Nov. 19, 1996

[51] Int. Cl.[6] ..... F25B 43/02

[52] U.S. Cl. ..... 62/471; 165/117

[58] Field of Search ..... 62/219, 220, 221, 62/471; 165/117

[56] References Cited

U.S. PATENT DOCUMENTS

| | | | |
|---|---|---|---|
| 3,022,638 | 2/1962 | Caswell et al. | 62/220 |
| 3,191,396 | 6/1965 | Ruddock | 62/219 |
| 3,768,539 | 10/1973 | Chamberlain et al. . | |
| 4,154,642 | 5/1979 | Mattern et al. . | |
| 4,520,866 | 6/1985 | Nakajima et al. . | |
| 5,561,987 | 10/1996 | Hartfield et al. . | |
| 5,645,124 | 7/1997 | Hartfield et al. | 165/117 |

*Primary Examiner*—Henry A. Bennett
*Assistant Examiner*—Susanne C. Tinker

[57] ABSTRACT

A vapor compression refrigeration system for cooling a liquid in which there is a spray dispenser for distributing liquid refrigerant over the tubes in a shell-and-tube type evaporator. The differential pressure in the refrigerant flow loop across the evaporator is the sole means of producing a flow through the spray dispenser. The evaporator is operated as a hybrid falling film heat exchanger, that is, in a semi-flooded condition. The lower portion of the evaporator shell is flooded with liquid refrigerant to wet the lower tubes in the tube bundle while the tubes in the upper portion are wetted only by refrigerant spray from the spray dispenser. The system is operated in a steady state condition whereby at least twenty-five percent (25%) of the tubes in the evaporator operate in a flooded heat transfer mode. The system allows a reduction in the amount of refrigerant charge in the system while at the same time avoiding the use of a recirculating system and pump.

17 Claims, 2 Drawing Sheets

CHILLER WITH HYBRID FALLING FILM EVAPORATOR

BACKGROUND OF THE INVENTION

1. Field of the Invention

This invention relates generally to systems for cooling a fluid. More particularly, the invention relates to a vapor compression refrigeration system for cooling a liquid such as water in which the evaporator of the system has a section that operates in a flooded mode and a section that operates in a falling film mode.

2. Description of the Prior Art

Vapor compression refrigeration systems for cooling water commonly referred to as "chillers" are widely used in air conditioning applications. Such systems have large cooling capacities, usually 350 kilowatts (100 tons) or greater and are used to cool large structures such as office buildings, large stores and ships. In a typical application employing a chiller, the system includes a closed chilled water flow loop that circulates water from the evaporator of the chiller to a number of air-to-water heat exchangers located in the space or spaces to be cooled. Another application for a chiller is as a process cooler for liquids in industrial applications. FIG. 1 illustrates the general arrangement of a typical prior art chiller 10. In chiller 10, refrigerant flows in a closed loop from a compressor 12 to a condenser 14, to an expansion device 16, to an evaporator 18 and thence back to the compressor 12. In the condenser 14 the refrigerant is cooled by transfer heating to a fluid flowing in heat exchange relationship with the refrigerant. This fluid is typically a cooling fluid such as water supplied from a source 20. In the evaporator 18 water from a loop generally designated 22 flows in heat exchange relationship to the refrigerant and is cooled by transferring heat to the refrigerant.

The evaporator of a chiller is typically a heat exchanger of the shell-and-tube type. A shell and tube heat exchanger comprises generally the outer shell in which are enclosed a plurality of tubes, termed a tube bundle. The liquid to be cooled, such as water, flows through the tube bundle. The energy required for boiling is obtained as heat from the water flowing through the tubes. When heat is removed the chilled water may then be used for air conditioning or for process liquid cooling. It is accordingly a prime objective of chiller design to optimize the heat exchange which takes place within the evaporator shell.

In general, the rate of heat transfer between a surface and a substance in a liquid state is much greater than the rate of heat transfer between the surface and the same substance in a gaseous state. For this reason, it is important for effective and efficient heat transfer performance to keep the tubes in a chiller evaporator covered, or wetted, with liquid refrigerant during operation of the chiller. Most prior art chiller evaporators accomplish the objective of keeping the tubes wetted by operating the evaporator in what is known as a "flooded mode". In a flooded mode the level of liquid refrigerant in the evaporator shell is sufficiently high so that all of the tubes are below the level of liquid refrigerant. FIG. 2 schematically illustrates a chiller 24 operating in a flooded condition wherein all of the tubes are below the refrigerant level 28. While operation of a chiller in a flooded condition ensures that all of the tubes are wetted, it also requires a relatively large amount of refrigerant, especially in large capacity chillers. If the cost of refrigerant is low, this consideration is of little significance, however, as the cost increases, the amount of refrigerant required can become a significant cost factor. The cost is reflected not only in the initial cost of the refrigerant charge required for the chiller, but also in maintenance and replacement costs over the chiller's lifetime.

New refrigerants have recently been introduced for use in such chillers to replace chlorinated refrigerants which are no longer used because they have been found to deplete the atmospheric ozone layer. Such new refrigerants are significantly more expensive than those which they have replaced. As a result, reducing the amount of refrigerant needed to charge a chiller's system can result not only in significant dollar savings, but also assists in satisfying the needs to produce more environmentally friendly products.

One approach to making use of a smaller refrigerant charge has been to use what is known as a "falling film" evaporator. The concept of a falling film evaporator is premised on the fact that heat transfer between a refrigerant and an external surface of a tube is primarily by convection and conduction, and that adequate heat transfer performance can be obtained not only by submerging the tube in a pool of liquid refrigerant but also by maintaining a continuously replenished film of liquid on the external surface of the tube. Accordingly, rather than wetting the tubes by submerging them in liquid refrigerant, the amount of refrigerant charge required in the chiller may be reduced by installing a means for dispensing a flow of liquid refrigerant over the tubes. The refrigerant flow keeps the surface of the tubes wet with a film of liquid refrigerant so that the heat transfer efficiency of the evaporator is maintained without the necessity of keeping the entire tube bundle flooded with liquid refrigerant. Such a flow may be attained by spraying liquid refrigerant on to the upper tubes in the evaporator tube bundle. The refrigerant then covers the upper tubes and drains down to the lower tubes below it by gravity flow. It is for this reason that such a heat exchanger is called a "falling film" evaporator. It is extremely important in a falling film evaporator that there be a sufficient flow of liquid refrigerant over the tube bundle so that all of refrigerant does not evaporate at the upper levels thereby leaving the lowest tubes unwetted and thereby incapable of affecting heat transfer.

One factor affecting the ability of a liquid to wet a surface is the liquid's surface tension. In general, the lower the surface tension, the better a liquid's ability to wet the surface. Water, for example, has a relatively high surface tension and therefore is a relatively poor wetting agent. Some of the refrigerants now in wide spread use have very low surface tensions, that is, less than thirty dynes per centimeter at 26.6 Celsius, and thus good wetting ability. Examples of such refrigerants include R-134A, R-410A, R-407C, R-404 and R-123.

It has been found with falling film evaporators, particularly when using refrigerants having a relatively high surface tension, that it may not be possible to achieve good heat transfer efficiency at an acceptable cost when the rate of refrigerant being dispensed on the tubes is equal to the total flow rate of refrigerant through the evaporator. The term re-circulation ratio is used to compare the ratio of the dispensed refrigerant flow rate to the total flow rate through the evaporator. When these flows are equal, the circulation ratio is said to equal one. In order to produce a sufficient flow of liquid refrigerant over the tubes in a falling film evaporator, a well known method in the prior art is to include a mechanical pump to re-circulate the refrigerant within the evaporator shell. FIG. 3 schematically illustrates a falling film type evaporator 30 in a chiller system 32. In contrast to the flooded evaporator illustrated in FIG. 2, it is noted that the refrigerant flowing from the expansion device 16 flows via a supply line 35 into the evaporator shell 36 to a dispensing device commonly known as a spray deck 38 overlying the upper most level of tubes 40. A re-circulation circuit including a re-circulating pump 42 draws liquid refrigerant from the bottom of the evaporator shell through line 44 and delivers it through line 46 to the supply line 35 where it is again distributed through the spray deck 38. The re-circulation system thus ensures that there is an adequate flow through the spray deck 38 to keep the tubes wetted.

In such a falling film evaporator system, all the tubes may be maintained in a wetted condition with the level 48 of the pool of liquid refrigerant in the evaporator below the lowest tube in the tube bundle. In order to ensure that all the tubes in the bundle are wetted, the re-circulation ratio (the ratio of spray deck flow rate to the total flow rate through the evaporator) may be on the order of ten to one. Because the evaporator can operate efficiently without the tubes being flooded, the amount of refrigerant necessary to charge such a system can be correspondingly reduced when compared to a system having an evaporator that operates in a flooded condition. It has been found however that the added cost of the re-circulation system, particularly the pump, may negate any savings realized by using less refrigerant. Obvious drawbacks to the need for a pump include increased costs, lower reliability and higher maintenance costs. Less obvious, but extremely significant, are the increased parasitic power consumption and reduced net materials utilization in a chiller requiring a recirculation pump. Specifically, if a pump is used to ensure complete wetting in a falling film evaporator, the parasitic power consumption translates to an approximately 1%–2% increase in the chiller power consumption; this is considered to be a significant increase in today's high efficiency chiller market, and a definite disadvantage from the global warming perspective.

SUMMARY OF THE INVENTION

It is an object of the present invention to provide a chiller system with a portion of the system evaporator operating in a falling film mode and a portion operating in a flooded mode.

It is another object of the invention to operate a combined falling film/flooded evaporator without a re-circulation system.

It is yet another object of the invention to operate a two pass evaporator with the first pass operating in a flooded mode and the second operating in a falling film mode.

It is still another object of the invention to provide a two pass evaporator for a chiller system wherein the heat transfer tubes in the first pass are re-entrant cavity type heat transfer tubes and those in the second pass are condenser type heat transfer tubes.

It is further object of the invention to provide a two pass evaporator with the first pass operating in a flooded mode and the second pass operating in a falling film mode and wherein a single tube type provides optimum heat transfer in both modes.

These and other objects of the present invention are attained by a vapor compression refrigeration system for cooling a liquid which includes a compressor, condenser, expansion device and evaporator, all interconnected in series to form a closed refrigerant flow loop for circulating a refrigerant therethrough. The evaporator of the system includes an outer shell having an upper end and a lower end and a refrigerant inlet and outlet formed therein. The evaporator further includes a plurality of substantially horizontal heat transfer tubes contained within the outer shell. At least a portion of the heat transfer tubes are adjacent the upper end of the shell and at least a portion of the tubes are adjacent the lower end of the shell. The tubes are adapted to have the liquid to be cooled flowed therethrough. The evaporator also includes means for receiving refrigerant passing to the outer shell through the refrigerant inlet and for dispensing the refrigerant onto the heat transfer tubes located adjacent the upper end of the outer shell. The closed refrigerant flow loop of the refrigeration system is configured so that the level of liquid refrigerant within the outer shell is maintained at a level such that at least twenty-five percent (25%) of the horizontal tubes are immersed in liquid refrigerant during steady state operation of the refrigeration system. The horizontal tubes, which are not immersed in liquid refrigerant, operate in a falling film heat transfer mode. During such steady state operation, the rate of refrigerant flow through the means for dispensing is no greater than the total rate of refrigerant flow from the refrigerant inlet to the refrigerant outlet.

In a preferred embodiment, the evaporator is of the type wherein the liquid to be cooled makes two passes through the outer shell. A first pass is through a first group of horizontal heat transfer tubes adjacent the lower end of the shell and a second pass is through a second group of horizontal tubes.

BRIEF DESCRIPTION OF THE DRAWINGS

Other objects and advantages of the present invention will be apparent from the following detailed description in conjunction with the accompanying drawings, wherein like reference numerals identify like elements, and in which.

DESCRIPTION OF THE PREFERRED EMBODIMENT

Figure 1:
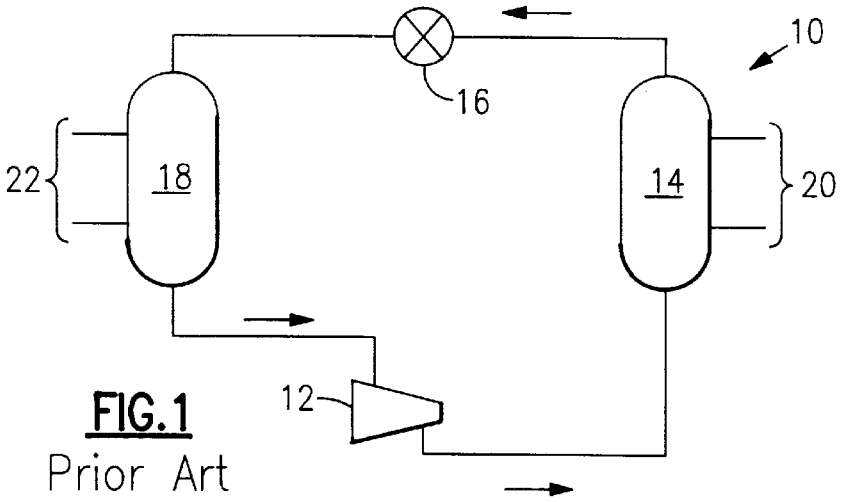
FIG.1 Prior Art
FIG. 1 is a schematic diagram of a prior art chiller system.
Figure 2:
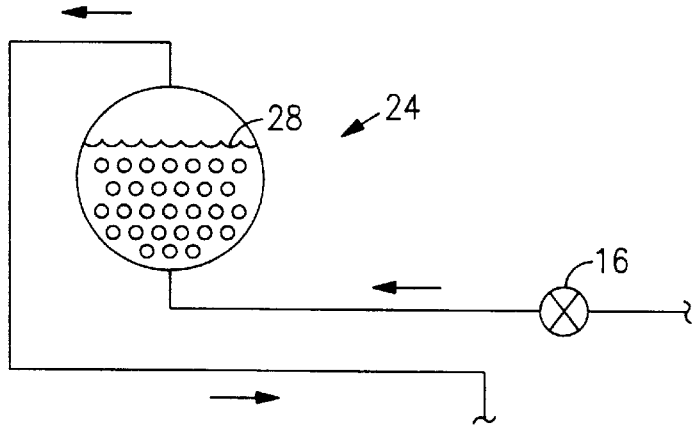
FIG.2 Prior Art
FIG. 2 is a schematic diagram of a portion of a prior art chiller system having a flooded evaporator.
Figure 3:
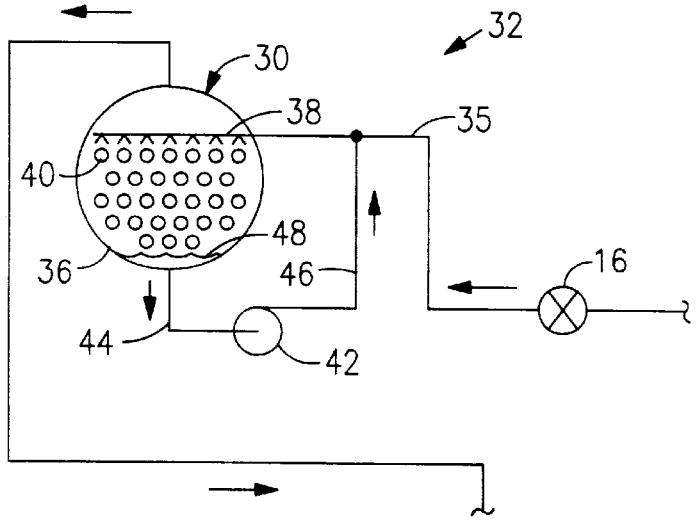
FIG.3 Prior Art
FIG. 3 is a schematic diagram of a portion of a prior art chiller system having a falling film evaporator.
Figure 4:
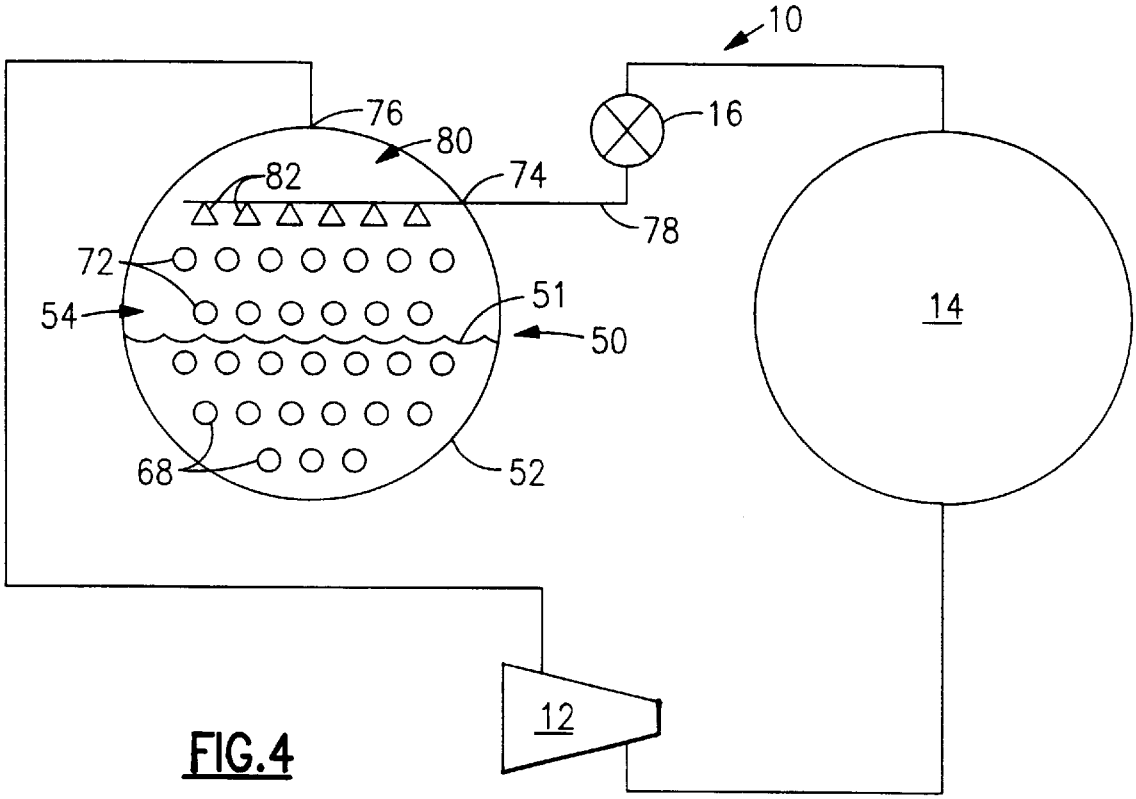
FIG. 4 is a schematic diagram of a chiller system having a hybrid falling film/flooded evaporator according to the present invention.

FIG. 4 schematically illustrates a chiller 10 incorporating a hybrid falling film/flooded evaporator 50 according to the present invention. The chiller 10 incorporates a standard closed refrigerant flow loop wherein refrigerant flows from a compressor 12 to a condenser 14 to an expansion device 16 to the evaporator 50 and thence back to the compressor 12.

Figure 5:
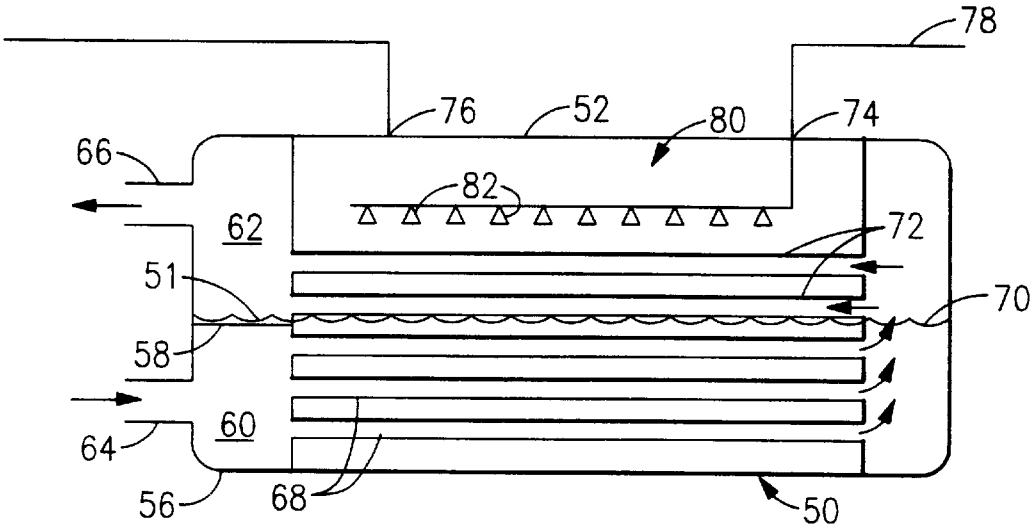
FIG. 5 is a simplified section of the hybrid falling film/flooded evaporator of the type illustrated in FIG. 4.

The evaporator 50 includes an outer shell 52 through which passes a plurality of horizontal heat transfer tubes 54 in a tube bundle. With further reference to FIG. 5, in the illustrated embodiment, the evaporator is of the two pass type having a water box 56 at one end thereof, having a partition 58 which divides it into an inlet section 60 and an outlet section 62, respectively communicating with a water inlet 64 and outlet 66. Water passing through the inlet 64 to the inlet section 60 flows through a first group of tubes 68 adjacent the lower end of the evaporator shell 50 to the opposite end 70 where it reverses direction and is returned through a second group of tubes 72, adjacent the upper end of the shell, to the outlet section 62 of the water box 56 where it is directed out of the water box through the outlet conduit 66. As is well known, if desired, more than two passes of the water through the shell 52 may be obtained by using more partitions dividing the tubes into several distinct, interconnected groups.

In operation, refrigerant enters the outer shell 52 of the evaporator 50 through a refrigerant inlet 74 in a primarily liquid state and exits from the evaporator shell through a refrigerant outlet 76 in a primarily gaseous state.

As illustrated in both FIGS. 4 and 5, the refrigerant entering the evaporator through the inlet 74 via inlet conduit 78 passes to a distribution system 80, which is arranged in overlying relationship with the upper most level of the second group of tubes 72. The distribution system comprises an array of spray heads or nozzles 82, which are arranged above the upper most level of tubes so that all refrigerant which passes into the evaporator shell is suitably dispensed or is sprayed onto the top of the tubes.

In steady state operation, the charge of refrigerant within the system 10 and the overall design of the closed refrigerant flow loop is configured so that the level 51 of liquid refrigerant within the outer shell 52 is maintained at a level such that at least twenty-five percent (25%) of the horizontal heat transfer tubes near the lower end of the shell are immersed in liquid refrigerant.

As a result, during such steady state operation, the evaporator 50 operates with tubes in the lower section of the evaporator operating in a flooded heat transfer mode while those which are not immersed in liquid refrigerant operate in a falling film heat transfer mode.

In a high efficiency evaporator, it is extremely important that all heat transfer tubes are sufficiently wetted at all times to effect optimum heat transfer from all tubes. In order to achieve this result, a falling film/flooded evaporator, according to the present invention, shall operate with between twenty-five percent (25%) and seventy-five percent (75%) of the horizontal heat transfer tubes immersed in liquid refrigerant during steady state operation of the refrigeration system. In a preferred embodiment, the system is designed such that approximately fifty percent (50%) of the horizontal heat transfer tubes are immersed in liquid refrigerant during steady state operation of the refrigeration system.

While the hybrid evaporator is illustrated and has been described in connection with a bottom-to-top pass arrangement, it could also be applied to a side-by-side arrangement. In such an arrangement, entering hot water passes through one side of the tube bundle and relatively cold water passes through the other side of the tube bundle.

In yet another preferred embodiment of the invention, the evaporator 50 is of the type described above wherein the liquid to be cooled makes two passes through the outer shell 52. In this embodiment, the first or lower group of tubes 68 are what are known as re-entrant cavity type heat transfer tubes, which are well known for their high performance in flooded type evaporators. An example of such re-entrant cavity tube is a Turbo B1-3, commercially available from the Wolverine Tube Company. The second or upper group of heat transfer tubes 72, in this embodiment, are of the type generally designed for use in condenser applications and may specifically be of the "Spike type condenser tube" type commercially available from the Wolverine Tube Company as Turbo C1 or C2 heat transfer tubes.

As will be seen, the use of the different types of heat transfer tubes in the upper and lower sections allows both the flooded and falling film sections of the evaporator to achieve high heat transfer coefficients. It should be further appreciated however that the ultimate goal is optimizing heat transfer in both the falling film and flooded evaporator sections. The tubes need not be different. This goal could be realized with a single tube that provides optimum heat transfer in both modes.

The benefits of the described arrangement are particularly beneficial when used with a two-pass bottom-to-top type evaporator. In order to fully appreciate such benefits, it should first be understood that in a typical two pass evaporator, the temperature of the water entering at the inlet 64 may be approximately 54 degrees F., this water is cooled to approximately 47 to 48 degrees F. at the end of the first pass 70 and then may be cooled several additional degrees to approximately 44 degrees F. where it passes from the evaporator at the outlet 66. Accordingly, the temperature of the water passing through the tubes is relatively high in the lower or pool boiling section, while it is relatively low in the upper or falling film heat transfer section.

With this in mind, the benefits of the present embodiment may be explained in the following manner. Pool boiling coefficients are approximately proportional to the square of wall super-heat ($\Delta T_{WS}$), defined as the difference between the tube wall temperature and the saturation temperature of the refrigerant. On the contrary, falling film evaporation coefficients are approximately inversely proportional to the fourth root of wall super-heat. Thus, in the first water pass of an evaporator having a bottom-to-top pass arrangement, the wall super-heat is relatively high which results in high nucleate boiling coefficients. However, assuming a flooded evaporator and the same type of heat transfer tubes in the second pass, nucleate boiling coefficients can reduce by a factor of three to four in the second pass where the wall's super-heat become small as the tube-side fluid becomes relatively cold. In a typical high efficiency chiller, the difference between water temperature and refrigerant saturation temperature may be of the order of 12 degrees F., where water enters the heat exchanger and it may be as low as 1 to 2 degrees F., where water exits the heat exchanger. Accordingly, as the temperature difference becomes small, as they are in the second pass, falling-film heat transfer coefficients become higher than pool boiling coefficients. This is especially true if appropriate heat transfer surfaces are employed in both the water passes as in the present embodiment.

It should thus be appreciated that according to the present invention, a heat exchanger is operated without any refrigerant recirculation pump in a manner to achieve and take advantage of high heat transfer coefficients in both pool boiling and falling film evaporation modes.

What is claimed is:

1. A vapor compression refrigeration system for cooling a liquid including a compressor, a condenser, an expansion device, and an evaporator, all of which are connected together in series to form a closed refrigerant flow loop for circulating a refrigerant therethrough, said evaporator comprising:

an outer shell having an upper end and a lower end, said shell having one refrigerant inlet and one refrigerant outlet therein;

a plurality of substantially horizontal heat transfer tubes contained within said outer shell, at least a portion of said tubes being adjacent the upper end of said shell and at least a portion of said tubes being adjacent the lower end of said shell, said tubes being adapted to have a liquid to be cooled flowed therethrough; and means for receiving refrigerant passing to said outer shell through said refrigerant inlet and for dispensing refrigerant onto said heat transfer tubes located adjacent said upper end of said outer shell;

and wherein said closed refrigerant flow loop is configured so that the level of liquid refrigerant within said outer shell is maintained at a level such that more than twenty-five percent (25%) of said horizontal tubes are immersed in liquid refrigerant during steady state operation of said refrigeration system.

2. The system of claim 1 wherein said closed refrigerant flow loop is further configured so that the rate of refrigerant flow through said means for dispensing is no greater than the total rate of refrigerant flow from said refrigerant inlet to said refrigerant outlet.

3. The system of claim 1 wherein said horizontal tubes, which are not immersed in liquid refrigerant, operate in a falling film heat transfer mode during steady state operation of said refrigeration system.

4. The system of claim 1 wherein between twenty-five percent (25%) and seventy-five percent (75%) of said horizontal tubes are immersed in liquid refrigerant during steady state operation of said refrigeration system.

5. The system of claim 4 wherein between at least forty percent (40%) and sixty percent (60%) of said horizontal tubes are immersed in liquid refrigerant during steady state operation of said refrigeration system.

6. The system of claim 5 wherein preferably approximately fifty percent (50%) of said horizontal tubes are immersed in liquid refrigerant during steady state operation of said refrigeration system.

7. The system of claim 3 wherein said portion of heat transfer tubes adjacent the upper end of said shell are condenser type heat transfer tubes, and, wherein said portion of heat transfer tubes adjacent the lower end of said shell are re-entrant cavity type heat transfer tubes.

8. The system of claim 3 wherein said portion of heat transfer tubes adjacent the upper end of said shell and said portion of heat transfer tubes adjacent the lower end of said shell are the same type of tube.

9. The system of claim 1 wherein said evaporator is of the type wherein said liquid to be cooled makes two passes through said outer shell, a first pass through a first group of said horizontal heat transfer tubes adjacent said lower end of said shell in which said liquid is reduced in temperature from an inlet temperature to an intermediate temperature, and a second pass through a second group of said horizontal heat transfer tubes, overlying said first group of tubes, in which said liquid is further reduced in temperature from said intermediate temperature to a lower outlet temperature.

10. The system of claim 9 wherein said closed refrigerant flow loop is further configured so that the rate of refrigerant flow through said means for dispensing is no greater than the total rate of refrigerant flow from said refrigerant inlet to said refrigerant outlet under steady state operating conditions.

11. The system of claim 10 wherein said horizontal heat transfer tubes, which are not immersed in liquid refrigerant, operate in a falling film heat transfer mode during steady state operation of said refrigeration system.

12. The system of claim 11 wherein between twenty-five percent (25%) and seventy-five percent (75%) of said horizontal heat transfer tubes are immersed in liquid refrigerant during steady state operation of said refrigeration system.

13. The system of claim 12 wherein between at least forty percent (40%) and sixty percent (60%) of said horizontal heat transfer tubes are immersed in liquid refrigerant during steady state operation of said refrigeration system.

14. The system of claim 13 wherein preferably approximately fifty percent (50%) of said horizontal heat transfer tubes are immersed in liquid refrigerant during steady state operation of said refrigeration system.

15. The system of claim 9 wherein said first group of horizontal heat transfer tubes are re-entrant cavity type heat transfer tubes, and wherein said second group of horizontal heat transfer tubes are condenser type heat transfer tubes.

16. The system of claim 1 in which said refrigerant has a surface tension equal to or less than thirty (30) dynes per centimeter at 26.6 degrees Celsius.

17. The system of claim 16 in which said refrigerant is selected from the group consisting of refrigerants R-134a, R-410A, R-407C, R-404 and R-123.

* * * * *